US007019703B2

(12) United States Patent
Webb et al.

(10) Patent No.: US 7,019,703 B2
(45) Date of Patent: Mar. 28, 2006

(54) ANTENNA WITH ROTATABLE REFLECTOR

(75) Inventors: David B. Webb, Dallas, TX (US); Scott Imbery, Copper Canyon, TX (US); Kevin R. Krebs, Plano, TX (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/709,476

(22) Filed: May 7, 2004

(65) Prior Publication Data

US 2005/0248495 A1 Nov. 10, 2005

(51) Int. Cl.
*H01Q 3/04* (2006.01)

(52) U.S. Cl. ..... 343/761; 343/700 MS; 343/766

(58) Field of Classification Search ..... 343/761, 343/839, 781 R, 781 P, 840, 700 MS, 766, 343/882

See application file for complete search history.

(56) References Cited

U.S. PATENT DOCUMENTS

| | | | | | |
|---|---|---|---|---|---|
| 2,421,593 | A * | 6/1947 | Bishop | ..... | 343/761 |
| 2,973,518 | A * | 2/1961 | Jensen | ..... | 343/837 |
| 3,064,258 | A * | 11/1962 | Hatkin | ..... | 343/757 |
| 3,757,342 | A * | 9/1973 | Jasik et al. | ..... | 343/738 |
| 3,949,404 | A * | 4/1976 | Fletcher et al. | ..... | 343/761 |
| 4,071,847 | A | 1/1978 | Pickles | | |
| 4,260,992 | A * | 4/1981 | Anderson et al. | ..... | 343/761 |
| 4,538,175 | A | 8/1985 | Balbes et al. | | |
| 4,626,863 | A * | 12/1986 | Knop et al. | ..... | 343/781 P |
| 4,920,350 | A | 4/1990 | McGuire et al. | | |
| 5,191,350 | A | 3/1993 | Hemmie | | |
| 5,202,699 | A | 4/1993 | Hemmie et al. | | |
| 5,473,335 | A | 12/1995 | Tines | | |
| 6,150,987 | A | 11/2000 | Sole et al. | | |
| 6,320,509 | B1 * | 11/2001 | Brady et al. | ..... | 340/572.7 |
| 6,417,814 | B1 | 7/2002 | Hupka et al. | | |
| 6,429,827 | B1 | 8/2002 | Hsueh et al. | | |
| 6,445,353 | B1 | 9/2002 | Weinbrenner | | |

* cited by examiner

*Primary Examiner*—Michael C. Wilmer
(74) *Attorney, Agent, or Firm*—Babcock IP, LLC

(57) ABSTRACT

A directional antenna formed by associating a stationary generally omni-directional antenna element with an RF reflector formed from, for example, a folded, parabolic or elliptical RF reflecting surface. Rotating the RF reflector about the stationary antenna element creates a directional characteristic in the resulting antenna over, for example, a 360 degree range of azimuth. Rotation of the RF reflector may be remotely driven by a motor coupled, for example, to a gear connected to the RF reflector. The direct connection of the antenna element and the enclosed lightweight rotating assembly provide a reliable, easy to install and cost effective antenna.

23 Claims, 4 Drawing Sheets

ANTENNA WITH ROTATABLE REFLECTOR

BACKGROUND OF INVENTION

1. Field of the Invention

The invention relates to antennas. More specifically, the invention relates to a highly directional rotatable antenna module suitable for use, for example, with consumer multi-channel multi-point distribution systems (MMDS).

2. Description of Related Art

MMDS are useful for communications and or entertainment. A consumer may have several MMDS sources from which to choose from and each of the different MMDS sources may not always be available/in service. To select between sources and or obtain the best possible signal strength, a user may be required to access, reposition and or redirect an antenna.

Rotatable antennas, for example TV antennas equipped with rotators, have previously used motors to allow a user to remotely point the antenna to a desired azimuth direction where the strongest signal for a desired channel/frequency is available. However, because the antenna feed is rigidly coupled to the antenna, rotation is limited to a 360 degree (or less) span with a stop and associated sensors for disabling the motor when the stop is reached from either direction. Where a rotator with a stop is used, to move between one side of the stop and the other, the antenna must be reversed across its full sweep causing a period of interrupted reception. Rotatable antennas with a full sweep, for example surveillance radar antennas, require use of a rotary joint or similar rotatable feed coupling on the antenna feed connection, which increases costs and introduces an opportunity for signal losses.

Competition within the antenna industry has created a need for antennas that are configurable for remote redirection having minimized materials and manufacturing costs.

Therefore, it is an object of the invention to provide an antenna, which overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
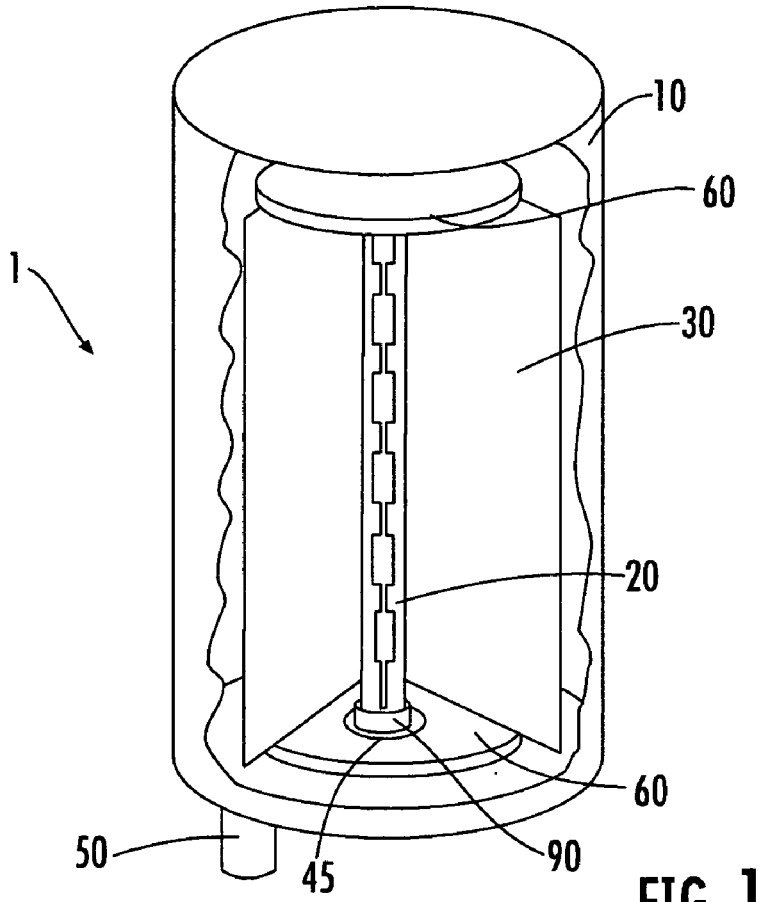
FIG. 1 shows a partial cut-away isometric view of a first embodiment of the invention.
Figure 2:
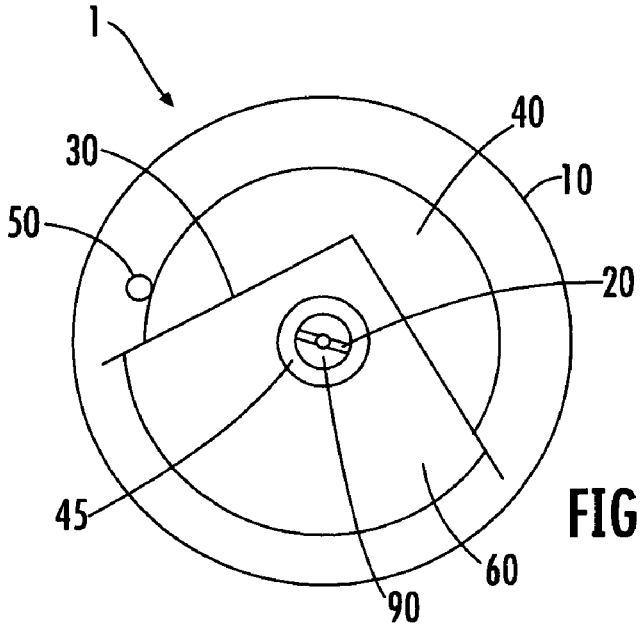
FIG. 2 shows a top section view of the first embodiment of the invention.

As shown in FIGS. 1 and 2, an antenna 1 may be optimized for use with MMDS signals. A Radio frequency (RF) transmissive radome 10 encloses a fixed omni-directional antenna element 20. An RF reflector 30 formed from an RF reflective material, for example metal or metal coated material, is arranged proximate the omni-directional antenna element 20 to receive and or transmit RF from/into a desired direction. The RF reflector 30 may be mounted on a rotatable gear 40 driven by a motor 50, for example a stepper motor. Alternatively, the motor 50 may be configured for direct drive, coupled to the RF reflector 30 at the axis of rotation and located at the end opposite from the antenna element 20 feed connection.

An angle of the RF reflector 30 may be adjusted larger or smaller to configure the azimuth directional characteristic of the antenna 1. Alternatively, the RF reflector 30 may be formed with a shape configured for a desired azimuth pattern, for example, a parabolic or elliptical curve. In these configurations, the antenna element 20 may be generally positioned at a focus point of the elliptical or parabolic curve. Elevational coverage of the antenna may be adjusted by adding RF absorbing elements 60 and or additional reflectors at either end of the RF reflector 30.

Because the RF reflector 30 rotates enclosed within the radome 10, the reflector 30 and associated structure need not be reinforced to resist wind loading and therefore may be formed of relatively lightweight materials. The rotatable gear 40 may be keyed to rotate about a low friction bearing surface with a locating shoulder, for example a plastic bearing ring 45. A center pin may be located at the top of the radome 10 to operate as a guide for the rotation of the RF reflector 30, allowing further reduction in the structural requirements of the RF reflector 30. As the rotating assembly is lightweight, a relatively inexpensive low torque motor 50 may be used.

Figure 3A:
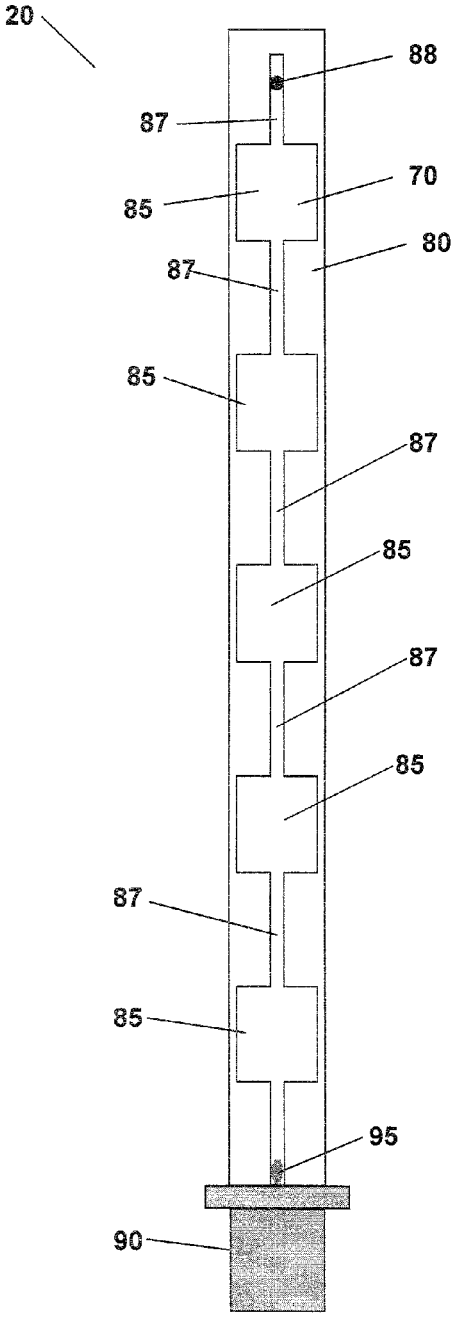
FIG. 3*a* shows a first side (front) view of an antenna element of the first embodiment of the invention.
Figure 3B:
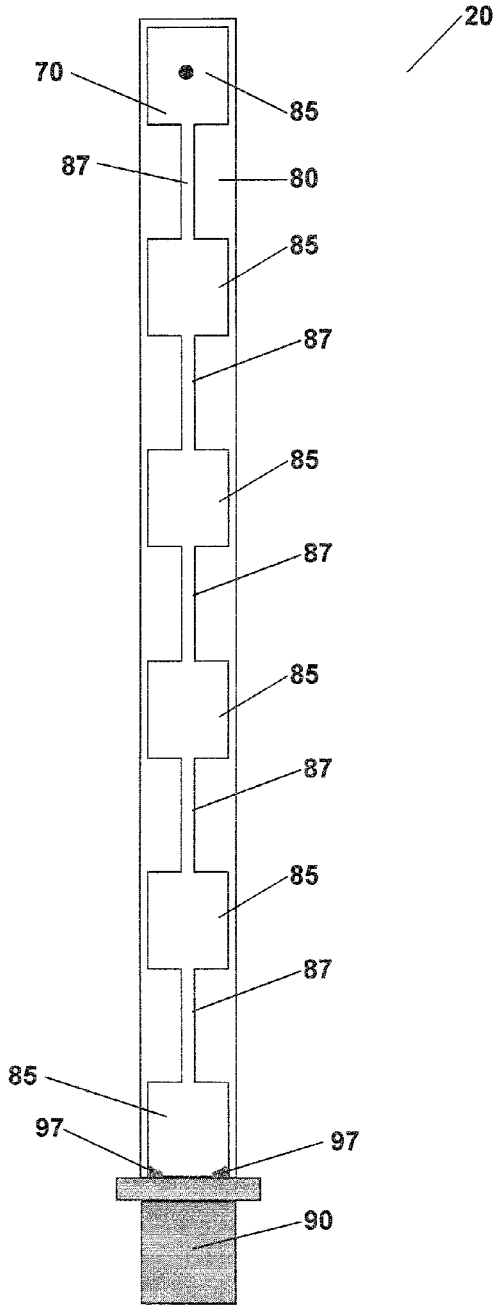
FIG. 3*b* shows a second side (back) view of an antenna element of the first embodiment of the invention.
Figure 3C:
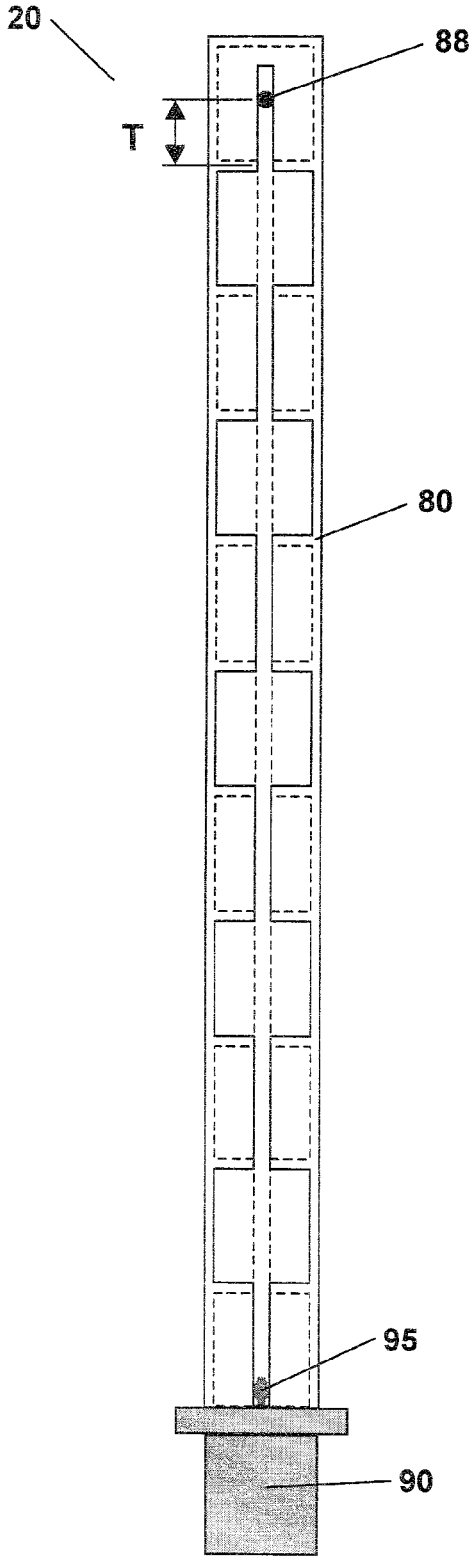
FIG. 3*c* shows a first side (front) view of an antenna element of the first embodiment of the invention, with hidden lines to show the alignment of transmission lines and ground traces located on either side of the antenna element.
Figure 3D:
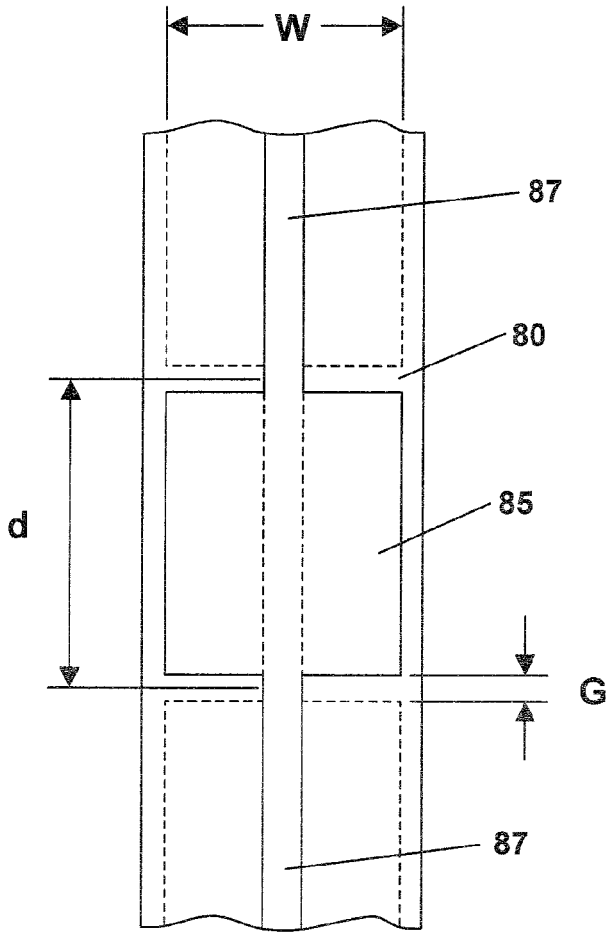
FIG. 3*d* is a close up view of a section of the antenna element of the first embodiment of the invention, identifying dimensions and interspacing of the conductive layers which form the antenna element.

A first embodiment of the omni-directional antenna element 20 is formed from conductive layers or trace(s) 70 on a printed circuit board (PCB) 80. As shown in FIGS. 3*a–d*, the conductive layers form a series of microstrip transmission line 87 sections along the length of the PCB 80. As shown in FIG. 3*c*, at each transition between sections, the transmission line 87 sections become the ground plane 85 trace of the adjacent section on the other side/alternate layer of the PCB 80 and vice versa. In the first embodiment, these overlaying sections are separated by 10 small radiating gaps "G" that serve as omni-directional radiating gap elements, forming a linear antenna array as will be appreciated by those familiar with the microstrip antenna arts. Alternatively, any number of transmission line sections and radiating gap elements could be used. The spacing "d" between gap "G" centers in FIG. 3*d* may be uniform along the array, and may be selected to be half a guide wavelength for the microstrip line at or near the desired center frequency of operation. Alternatively, other spacings may be used, including non-uniform spacing between radiating gap(s) "G". The radiating gap "G" and ground plane 85 widths "W" shown in FIG. 3*d* are adjusted to control the electrical parameters of the radiating gap "G", namely, the load admittance presented to the microstrip transmission line 87, as well as the radiation pattern. Similarly, the gap "G" and ground plane 87 widths "W" may be varied or uniform along the array.

In the first embodiment, the array is terminated in a short circuit 88 located a distance "T" approximately one-quarter guide wavelength of the microstrip line away from the center of the last radiating gap "G", forming a standingwave array. Those skilled in the art will appreciate that the line could also be terminated in a matched load, or some similar impedance. As indicated in FIGS. 3*a* and 3*b*, in the first embodiment the microstrip transmission line 87 and microstrip ground 85 traces at the connector end are electrically coupled, for example by soldering, to the inner conductor 95 and outer conductor 97, respectively, of a feed connection 90.

Antenna element 20 embodiments using trace(s) 70 on PCB 80 allow a plurality of different configurations, each tuned to a desired frequency or frequency band, to be quickly and cost effectively produced for use with the same surrounding components. Further, antenna tuning circuitry, for example capacitors, inductors and or resistors may be economically added to the PCB 80 for antenna impedance and or q-factor tuning.

In alternative embodiments the generally omni-directional antenna element 20 may be configured, for example, as a single dipole, linear array of dipole or dipole pair elements. The antenna element 20 need not be formed using a PCB 80; a stamped metal element, coil or other form of antenna structure may be applied as desired.

Because the omni-directional antenna element 20 is fixed in place, a low signal loss and inexpensive direct feed connection 90, for example, a standardized coaxial connector may be used. In alternative embodiments, the antenna element 20 may be coupled to diplexer, transceiver and or receiver circuits contained in the antenna 1 assembly.

Figure 4:
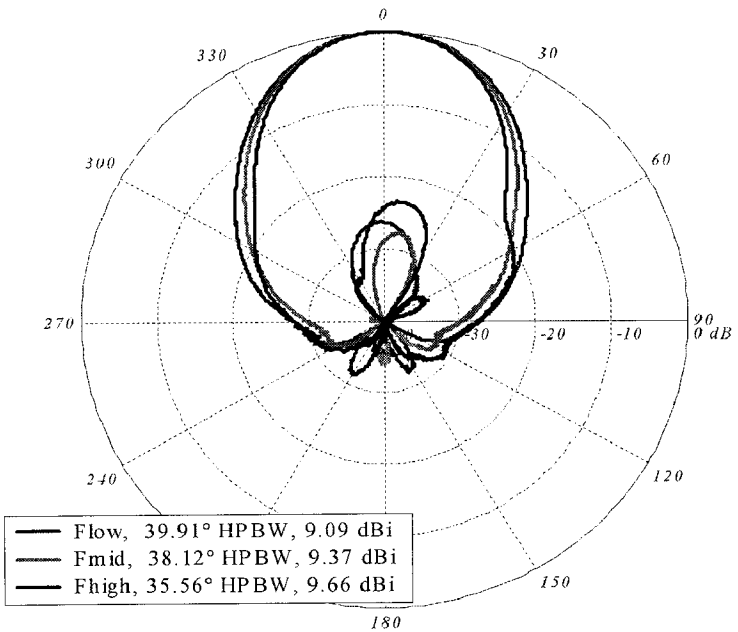
FIG. 4 shows azimuth angle test performance data of the first embodiment of the invention.
Figure 5:
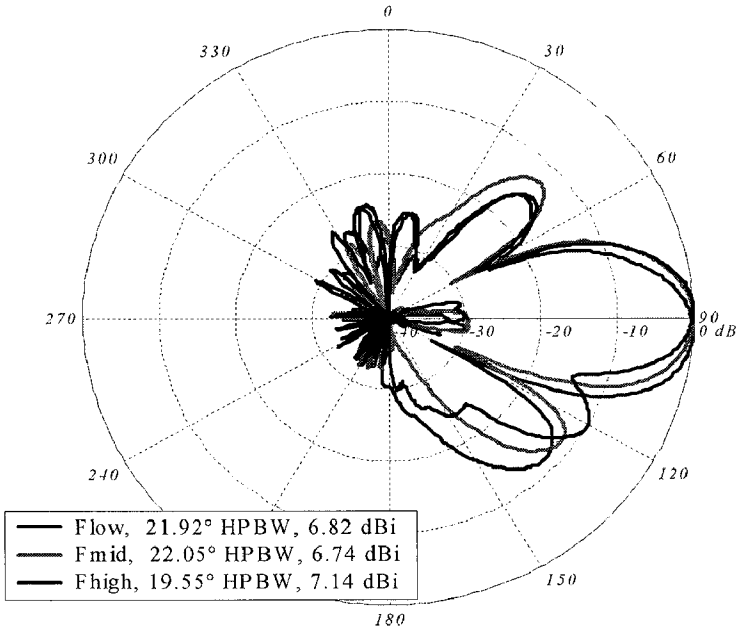
FIG. 5 shows elevation angle test performance data of the first embodiment of the invention.

As shown in FIGS. 4 and 5 the antenna 1 may be configured to have directional azimuth coverage (FIG. 4) in any desired direction by actuating the motor 50 to rotate the gear 40 and associated RF reflector 30 about the antenna element 20. Elevational coverage (FIG. 5), adjustable for example via the selected antenna element 20, reflector 30 and or RF absorbing elements 60, is fixed throughout the azimuth range.

The radome 10 may be configured to provide an environmental seal for the internal components and or a minimized wind load. Also, the radome 10 operates to conceal mechanical operation and or fragile components of the antenna 1, making it suitable for use/installation by untrained consumers.

Integrated with a receiver and or transceiver system, the motor 50 may be automatically or manually controlled to seek a specific signal and or the signal providing the strongest signal strength, which once detected may be focused in upon by selective positioning of the RF reflector 30. Because the control of the motor 50 may be via remote electrical control, the antenna 1 may be located in a remote location providing the best reception characteristics, for example at a high point on a structure or within attic space.

| Table of Parts | |
|---|---|
| 10 | radome |
| 20 | antenna element |
| 30 | RF reflector |
| 40 | gear |
| 45 | bearing ring |
| 50 | motor |
| 60 | RF absorbing element |
| 70 | trace |
| 80 | PCB |
| 85 | ground plane |
| 87 | microstrip transmission line |
| 88 | short circuit |
| 90 | feed connection |

-continued

| Table of Parts | |
|---|---|
| 95 | inner conductor |
| 97 | outer conductor |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

The invention claimed is:

1. A rotatable antenna, comprising:

an antenna element having a vertical axis;

a RF reflector rotatable about the vertical axis of the antenna element, the RF reflector mounted on a gear coupled to a motor; and a radome that surrounds the antenna and the RF reflector, the RF reflector rotatably coupled to the radome at a top position proximate the vertical axis of the antenna element.

2. The antenna of claim 1, further including at least one RF absorbing element at one of a top of the RF reflector, a bottom of the RF reflector and the top and the bottom of the RF reflector.

3. The antenna of claim 1, further comprising a radome enclosing the antenna element and a rotational path of the RF reflector.

4. The antenna of claim 1, further comprising a fixed feed connection coupled to the antenna element.

5. The antenna of claim 1, wherein the antenna element is at least one trace on a supporting substrate.

6. The antenna of claim 5, wherein the supporting substrate is a printed circuit board.

7. The antenna of claim 6, further comprising an antenna tuning circuit on the printed circuit board.

8. The antenna of claim 1, wherein the antenna element is metal.

9. The antenna of claim 1, wherein the antenna element has an omni-directional signal characteristic in a plane normal to the vertical axis.

10. The antenna of claim 1, wherein the RF reflector is metal.

11. The antenna of claim 1, wherein the RF reflector is one of a metalized and a metal coated substrate.

12. The antenna of claim 1, wherein the RF reflector has two planar surfaces joined to each other at an angle.

13. The antenna of claim 1, wherein the RF reflector has a parabolic curve shape.

14. The antenna of claim 1, wherein the RF reflector has an elliptical curve shape.

15. The antenna of claim 1, further including a diplexer coupled to the antenna element.

16. The antenna of claim 1, further including a transceiver circuit coupled to the antenna element.

17. The antenna of claim 1, further including a motor control circuit.

18. The antenna of claim 17, wherein the motor control circuit is configured to rotate the RF reflector, monitor at least one signal strength and rotate the RF reflector to a first position where the at least one signal strength is maximized.

19. The antenna of claim 18, wherein a signal identifier may be input into the motor control circuit; the motor control circuit operable to rotate the RF reflector to a second position at which a signal corresponding to the signal identifier is maximized.

20. The antenna of claim 1 wherein the gear is rotatably supported by a bearing ring.

21. A rotatable antenna, comprising:

an antenna element having a vertical axis;

a RF reflector rotatable about the vertical axis of the antenna element, the RF reflector mounted on a gear coupled to a motor;

the antenna element is a first trace on a printed circuit board;

the first trace has a first plurality ground traces alternating with a first plurality of microstrip transmission lines; and a second trace, electrically interconnected with the first trace at a short circuit proximate a top of the antenna element has a second plurality of ground traces alternating with a second plurality of microstrip transmission lines;

the first trace and second trace arranged whereby each of the first plurality of microstrip transmission lines of the first trace are aligned in an electrically isolated overlay with each of the second plurality of ground traces of the second trace.

22. The antenna of claim 21 wherein a plurality of gaps along the vertical axis are located between each of the overlay of the first plurality of microstrip transmission lines of the first trace and the second plurality of ground traces of the second trace.

23. The antenna of claim 22 wherein a distance between a centerpoint of the gaps along the vertical axis is one half wavelength of a desired operating frequency.

* * * * *